US008506277B2

(12) United States Patent
Yashiki

(10) Patent No.: US 8,506,277 B2
(45) Date of Patent: Aug. 13, 2013

(54) CYLINDRICAL CORE FOR MANUFACTURING ENDLESS BELT-SHAPED BODY, AND METHOD FOR MANUFACTURING ENDLESS BELT-SHAPED BODY

(75) Inventor: Yuichi Yashiki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 428 days.

(21) Appl. No.: 12/545,512

(22) Filed: Aug. 21, 2009

(65) Prior Publication Data

US 2010/0247779 A1 Sep. 30, 2010

(30) Foreign Application Priority Data

Mar. 26, 2009 (JP) ..... 2009-075967

(51) Int. Cl.
*B05C 13/02* (2006.01)

(52) U.S. Cl.
USPC ..... 425/101; 264/313

(58) Field of Classification Search
USPC ..... 425/101; 264/313
See application file for complete search history.

(56) References Cited

U.S. PATENT DOCUMENTS

2010/0247779 A1* 9/2010 Yashiki ..... 427/359

FOREIGN PATENT DOCUMENTS

| | | |
|---|---|---|
| JP | A-2002-91027 | 3/2002 |
| JP | A-2005-270805 | 10/2005 |
| JP | A-2006-116821 | 5/2006 |
| JP | A-2006-255616 | 9/2006 |
| JP | A-2006-256098 | 9/2006 |

OTHER PUBLICATIONS

Notification of Reasons for Refusal issued in Japanese Application No. JP 2009-075967 dated Jan. 25, 2011 (with translation).

* cited by examiner

*Primary Examiner* — Galen Hauth
(74) *Attorney, Agent, or Firm* — Oliff & Berridge, PLC

(57) ABSTRACT

A cylindrical core for manufacturing an endless belt-shaped body includes a cylindrical portion that includes a cylinder whose cylindrical shape is not maintainable without support when an outer surface thereof is orthogonal to the direction of gravitational force; and flange portions that are detachably mounted on both axial ends of the cylindrical portion, wherein the cylindrical core is used in a method for manufacturing an endless belt-shaped body, the method including applying a coating film forming resin solution onto an outer surface or an inner surface of the cylindrical portion in a state in which the flange portions are mounted on the cylindrical portion; drying a solvent of the coating film forming resin solution; and solidifying the coating film forming resin by heating in a state in which the flange portions are removed, to form the endless belt-shaped body.

9 Claims, 8 Drawing Sheets

CYLINDRICAL CORE FOR MANUFACTURING ENDLESS BELT-SHAPED BODY, AND METHOD FOR MANUFACTURING ENDLESS BELT-SHAPED BODY

CROSS-REFERENCE TO RELATED APPLICATIONS

This application is based on and claims priority under 35 USC 119 from Japanese Patent Application No. 2009-075967 filed on Mar. 26, 2009.

BACKGROUND

1. Technical Field

The present invention relates to a cylindrical core for manufacturing an endless belt-shaped body, and a method for manufacturing an endless belt-shaped body.

2. Related Art

Hitherto, image forming apparatuses have widely employed resin endless belt-shaped bodies, what are called endless belts, as intermediate transfer bodies, onto each of which a visible image formed on a surface of an image carrier is temporarily transferred before being transferred onto a medium, and medium conveying members each of which conveys a medium by holding the medium on a surface thereof.

SUMMARY

According to an aspect of the invention, there is provided a cylindrical core for manufacturing an endless belt-shaped body, the cylindrical core including: a cylindrical portion that includes a cylinder whose cylindrical shape is not maintainable without support when an outer surface thereof is orthogonal to the direction of gravitational force; and flange portions that are detachably mounted on both axial ends of the cylindrical portion, wherein the cylindrical core is used in a method for manufacturing an endless belt-shaped body, the method including: applying a coating film forming resin solution onto an outer surface or an inner surface of the cylindrical portion in a state in which the flange portions are mounted on the cylindrical portion; drying a solvent of the coating film forming resin solution; and solidifying the coating film forming resin by heating in a state in which the flange portions are removed, to form the endless belt-shaped body.

BRIEF DESCRIPTION OF THE DRAWINGS

Exemplary embodiment(s) of the present invention will be described in detail based on the following figures, wherein:

FIG. 5A is an explanatory view illustrating a configuration in which the cylindrical portion is fit onto a step of the circumferential edge portion of the flange and FIG. 5B is an explanatory view illustrating a configuration in which the cylindrical portion is fit into a groove of the flange;

FIG. 10A is a side view illustrating the cylindrical core and FIG. 10B is a plan view illustrating the cylindrical core; and FIG. 11 is a graph illustrating results of measurement of temperature of a cylindrical core heated by a heating furnace in Experimental Example 1, in which an axis of abscissas represents time and an axis of ordinates represents temperature, wherein

Figure 1:
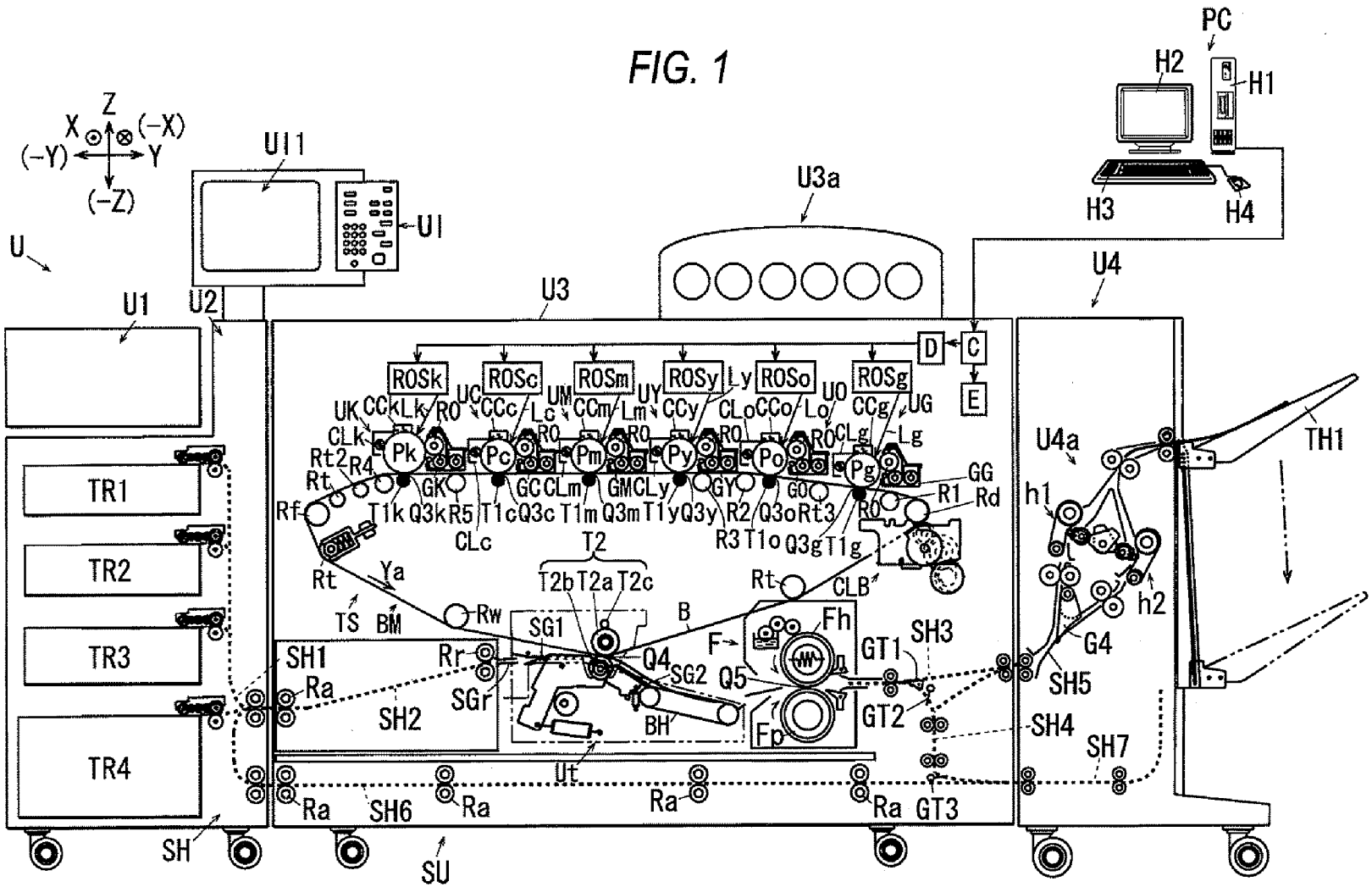
FIG. 1 is an explanatory view illustrating the entire image forming apparatus according to Embodiment 1 of the invention.

1 denotes a cylindrical core, 2 denotes a cylindrical portion, 3 denotes a flange portion, 6 denotes a coating film forming resin solution, B denotes endless belt-shaped body, intermediate transfer body, F denotes a fixing device, GG, GO, GY, GM, GC and GK denote development devices, $ROS_g$, $ROS_0$, $ROS_y$, $ROS_m$, $ROS_c$ and $ROS_k$ denote latent image forming devices, $P_y$, $P_m$, $P_c$, $P_k$, $P_o$ and $P_g$ denote image carriers, S denotes a medium T denotes a final transfer device, $T_{1g}$, $T_{1c}$, $T_{1y}$, $T_{2m}$, $T_{1c}$ and $T_{1k}$ denote primary transfer devices, U denotes an image forming apparatus, UG+GG, UO+GO, UY+GY, UM+GM, UC+GC and UK+GK denote visible image forming devices.

DETAILED DESCRIPTION

Next, specific examples of a mode for carrying out the invention (hereunder referred to as embodiments) are described hereinafter with reference to the accompanying drawings. However, the invention is not limited to the following embodiments.

For readily understanding the following description, in the drawings, it is assumed that the anteroposterior direction, the right-left direction, and the up-down direction correspond to the X-axis, Y-axis, and Z-axis, respectively, and that directions (or sides) respectively represented by arrows X, (−X), Y, (−Y), Z, and (−Z) correspond to frontward, rearward, rightward, leftward, upward, and downward directions (or sides).

In addition, in the drawings, each symbol of a circle with a central dot means an arrow directed from the rear of the paper on which the drawing is made to in front of the paper. Each symbol of a circle with a central cross means an arrow directed from in front of the paper to the rear of the paper.

In the following description described with reference to the drawings, the illustration of components other than members necessary for readily understanding the invention is appropriately omitted.

Embodiment 1

FIG. 1 is an explanatory view illustrating the entire image forming apparatus according to Embodiment 1 of the invention.

As illustrated in FIG. 1, an image forming apparatus U according to Embodiment 1 includes a user interface UI serving as an example of an apparatus operating portion, an image input apparatus UI serving as an example of an image information input apparatus, a paper feeding apparatus U2, an image forming apparatus body U3, and a paper processing device U4.

The user interface UI has a copy start key serving as an example of an operation start button, a copy number setting key serving as an example of a key for setting the number of copies, an input button such as a ten key serving as an example of a numeral input button, and a display device UI1.

The image input apparatus U1 includes an image scanner serving as an example of an image reading device. As illustrated in FIG. 1, in the image input apparatus U1, the original document (not shown) is read. Then, the read information is converted into image information that is input to the image forming apparatus body U3.

A client personal computer PC serving as an example of an image information transmission apparatus is connected to the image forming apparatus body U3 according to Embodiment 1. Image information is input from the client personal computer PC to the image forming apparatus body U3.

The client personal computer PC according to Embodiment 1 includes a computing machine, i.e., what is called a computer apparatus. The client personal computer PC includes a computer body H1 serving as an example of an image information transmission apparatus body H1, a display device H2 serving as an example of a display member, a keyboard H3 and a mouse H4, which serve as examples of an input member, a hard disk (HD) drive serving as an example of an information storage member (not shown), and the like.

The paper feeding apparatus U2 includes paper feeding trays TR1 to TR4 serving as an example of a plurality of paper feeding portions. In each of the paper feeding trays TR1 to TR4, sheets of recording paper S serving as example of media are accommodated. The sheets of recording paper S taken out of each of the paper feeding trays TR1 to TR4 are conveyed to the image forming apparatus body U3 through a paper feeding path SH1.

As illustrated in FIG. 1, the image forming apparatus body U3 includes an image recording portion for performing image recording on recording paper S conveyed from the paper feeding apparatus U2, a toner dispenser apparatus U3*a* serving as an example of a developer agent replenishing apparatus, a paper conveying path SH2, a paper discharge path SH3, a paper inverting path SH4, a paper circulating path SH6, and the like.

The image forming apparatus body U3 includes a control portion C, a laser drive circuit D serving as an example of a latent image writing apparatus drive circuit controlled by the control portion C, a power supply circuit E controlled by the control portion C, and the like. The laser drive circuit D outputs each of laser drive signals, which represent image information input from the image input apparatus UI and correspond to colors G (green), i.e., a green color, O (orange), i.e., an orange color, Y (yellow), i.e., a yellow color, M (magenta), i.e., a magenta color, C (cyan), i.e., a cyan color, K (black), i.e., a black color, to respective latent image forming apparatuses $ROS_9$ $ROS_0$, $ROS_y$, $ROS_m$, $ROS_c$, and $ROS_k$ at a predetermined time, so-called "timing".

Image carrier units UG, UO, UY, UM, UC, and UK respectively corresponding to the each of the color development devices GG, GO, GY, GM, CC, and SK serving as examples of developing devices are supported below the latent image forming apparatuses $ROS_g$, $ROS_0$, $ROS_y$, $ROS_m$, $ROS_c$, and $ROS_k$. Each of the image carrier units UC, UO, UY, UM, UC, and UK and the development devices GG, GO, GY, GM, GC, and GK are mounted detachably from the image forming apparatus body U3.

The black image carrier unit UK has a photosensitive drum Pk serving as an image carrier, a charging device $CC_k$, and a cleaner $CL_k$ serving as an example of an image carrier cleaning device. A development roll $R_0$ serving as an example of a development member of the black development device GK contacts the right side of the photosensitive drum $P_k$, as viewed in FIG. 1. Similarly, in each of the image carrier units UG to UC, an associated photosensitive drum $P_g$, $P_o$, $P_y$, $P_m$, or $P_c$, the associated charging device $CC_g$, $CC_o$, $CC_y$, $CC_m$, or $CC_c$, and the associated cleaner $CL_g$, $CL_o$, $CL_y$, $CL_m$, or $CL_c$ are arranged in contact with each other. The development roll R0 of each of the development devices GG to GC corresponding to the colors contacts the right side of the corresponding photosensitive drum among $P_g$ to $P_c$.

In Embodiment 1, the photosensitive drum $P_k$ corresponding to the color K is highly frequently used and has a large surface abrasion amount. Thus, the photosensitive drum $P_k$ is configured to have a large diameter, as compared with the diameters of the photosensitive drums $P_g$ to $P_c$ corresponding to the other colors. The photosensitive drum $P_k$ is adapted to withstand a high-speed rotation and to have a long life.

Each of the visible image forming members (UG+GG), (UO+GO), (UY+GY), (UM+GM), (UC+GC), and (UK+GK) is configured from one of the image carrier units UY to UO and one of the development devices GY to GO.

As illustrated in FIG. 1, each of the photosensitive drums $P_g$ to $P_k$ is uniformly electrically charged by an associated one of the charging devices $CC_g$ to $CC_k$. Then, an electrostatic latent image is formed on a surface of each of the photosensitive drums $P_g$ to $P_k$ using the associated laser beam $L_g$, $L_o$, $L_y$, $L_m$, $L_c$, or $L_k$ serving as an example of latent image writing light output by the associated latent image forming apparatus from among $ROS_g$ to $ROS_k$. The electrostatic latent image formed on the surface of each of the photosensitive drums $P_g$ to $P_k$ is developed by the associated development device from among GG to GK, into a toner image serving as an example of visible images having colors G (green), O (orange), Y (yellow), M (magenta), C (cyan), and K (black).

The toner images respectively formed on the photosensitive drums Pg to Pk are sequentially superposed by primary transfer rolls $T1_g$, $T1_o$, $T1_y$, $T1_m$, $T1_c$, and $T1_k$ onto the intermediate transfer belt B serving as both an endless belt-shaped body and an intermediate transfer body. The toner images transferred onto the intermediate transfer belt B are conveyed to a secondary transfer area Q4.

In the case of using black image data, only the black photosensitive drum $P_k$ and the development device GK are used, so that only a black toner image is formed.

After the primary transfer, residual toner on the surface of each of the photosensitive drums $P_g$ to $P_k$ is cleaned by the associated cleaner from among $CL_g$ to $CL_k$.

Figure 2:
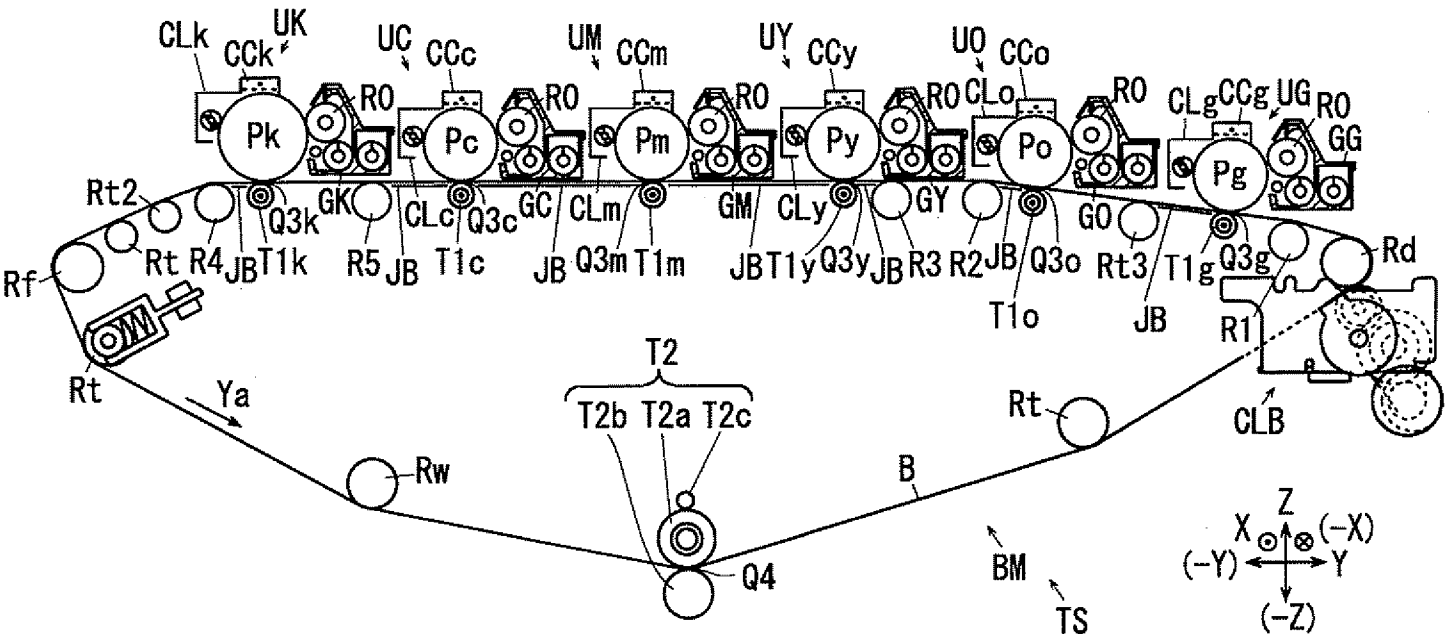
FIG. 2 is an explanatory view illustrating an important part of Embodiment 1 of the invention.

FIG. 2 is an explanatory view illustrating a primary part of Embodiment 1 according to the invention.

As illustrated in FIGS. 1 and 2, a belt module BM serving as an example of the intermediate transfer apparatus is supported below each of the visible image forming members (UG+GG) to (UK+GK).

The belt module BM has the intermediate transfer belt B. A belt drive roll Rd serving as an example of an intermediate transfer drive member is arranged at the right edge of the rear surface of the intermediate transfer belt B, as viewed in FIGS. 1 and 2. The belt drive roll $R_d$ rotationally drives the intermediate transfer belt B in the direction of the arrow $Y_a$. Support rolls $Rt_2$ and $Rt_3$ serving as examples of support members for rotatably supporting the intermediate transfer belt B are arranged to the left of the black photosensitive drum $P_k$ and between the photosensitive drums $P_g$ and $P_o$ on the rear surface of the intermediate transfer belt B. A plurality of tension rolls $R_t$ serving as examples of a tensile force giving member for giving a tensile force to the intermediate transfer belt B are arranged on the rear surface of the intermediate transfer belt B. In addition, a walking roll $R_w$ serving as an example of a meandering prevention member for preventing the intermediate transfer belt B from meandering, a plurality of idler rolls $R_f$ serving as examples of driven members, and a backup roll T2*a* serving as an example of a secondary transfer opposing member are arranged on the rear surface of the intermediate transfer belt B.

Accordingly, in the belt module BM according to Embodiment 1, the intermediate transfer belt B is stretched by the rolls $R_d$, Rt2, Rt3, $R_t$, $R_w$, $R_f$, T2*a*, and the like.

According to Embodiment 1, a first retracting roll R1 is arranged upstream of the primary transfer roll $T1_g$ corresponding to the color G and moving the belt in the direction of the arrow Ya, retracting roll R1 being an example of a first contacting/separating member supported so that it can move in belt contacting/separating directions perpendicular to the direction of arrow $Y_a$. The first retracting roll R1 according to Embodiment 1 is supported so that it can move between a first contacting position, at which the intermediate transfer belt B is brought into contact with the green photosensitive drum $P_g$, and a first separating position at which the intermediate transfer belt B is separated from the green photosensitive drum $P_g$.

A second retracting roll R2, which serves as an example of the second contacting/separating member constructed similarly to the first retracting roll R1, and a third retracting roll R3 serving as an example of a third contacting/separating member, are arranged in a line between the primary transfer rolls $T1_o$ and $T1_y$. The second retracting roll R2 according to Embodiment 1 is supported movably between a second contacting position, at which the intermediate transfer belt B is brought into contact with the orange photosensitive drum $P_o$, and a second separating position at which the intermediate transfer belt B is separated from the orange photosensitive drum $P_o$. The third retracting roll R3 according to Embodiment 1 is supported movably between a third contacting position, at which the intermediate transfer belt B is simultaneously brought into contact with the photosensitive drums $P_y$ to $P_c$ respectively corresponding to the colors Y, M, and C, and a third separating position, at which the intermediate transfer belt B is simultaneously separated from the photosensitive drums $P_y$ to $P_c$ respectively corresponding to the colors Y, M, and C.

A fourth retracting roll R4 serving as an example of a fourth contacting/separating member constructed similarly to each of the retracting rollers R1 to R3 is arranged downstream of the primary transfer roll T1*k* corresponding to the color K, which moves the belt in the direction of an arrow Ya. The fourth retracting roll R4 according to Embodiment 1 is supported movably between a fourth contacting position, at which the intermediate transfer belt B is brought into contact with the black photosensitive drum $P_k$, and a fourth separating position at which the intermediate transfer belt B is separated from the black photosensitive drum $P_k$.

A fifth retracting roll R5 serving as an example of a fifth contacting/separating member constructed similarly to each of the retracting rolls R1 to R4 is arranged between the primary transfer rolls T1*c* and T1*k*. The fifth retracting roll R5 according to Embodiment 1 is supported movably between a fifth contacting position, at which the black photosensitive drum $P_k$ and/or at least one of the set of the photosensitive drums $P_y$ to $P_c$ respectively corresponding to the colors Y, M, and C are brought into contact with the intermediate transfer belt B, and a fifth separating position at which a set of the photosensitive drums $P_y$ to $P_k$ is separated from the intermediate transfer belt B.

A flat electricity removing sheet metal JB serving as an example of the electricity removing member for removal of charges on the rear surface of the intermediate transfer belt B moving in the direction of the arrow Ya is arranged downstream of each of the primary transfer rolls T1*g* to T1*k*. The electricity removing sheet metal JB according to Embodiment 1 is arranged in noncontact with the intermediate transfer belt B. The electricity removing sheet metal JB according to Embodiment 1 can be placed at a distance of, e.g., 2 mm from the rear surface of the intermediate transfer belt B.

Belt support rolls $R_d$, $R_t$, $R_w$, $R_f$, T2*a*, and R1 to R5 are configured to serve as examples of intermediate transfer support members for rotatably supporting the intermediate transfer belt B from the rear surface thereof.

The belt module BM according to Example 1 includes the intermediate transfer belt B, the belt support rolls Rd, Rt, Rt2, Rt3, Rta, Rtb, Rw, Rf, T2*a*, R1 to R5, the primary transfer rolls T1*g* to T1*k*, the electricity removing sheet metal JB, and the like.

As illustrated in FIG. 1, a secondary transfer unit $U_t$ is arranged below the backup roll T2*a*. The secondary transfer unit $U_t$ has a secondary transfer roll T2*b* serving as an example of a secondary transfer member. The secondary transfer roll T2*b* is arranged to be separable from and contactable with the backup roll T2*a*, the two sandwiching the intermediate transfer belt B. As illustrated in FIGS. 1 and 2, a secondary transfer area Q4 is an area in which the secondary transfer roll T2*b* is press-contacted with the intermediate transfer belt B. A contact roll T2*c* serving as an example of a contact power feeding member abuts on the backup roll T2*a*. A secondary transfer device T2 serving as an example of the final transfer device includes the rolls T2*a* to T2*c*.

A secondary transfer voltage of the same polarity as the charged polarity of toner is applied from the power supply circuit, controlled by the control portion C, to the contact roll T2*c* at a preset timing.

As illustrated in FIG. 1, the paper conveying path SH2 is arranged below the belt module BM. Recording paper S supplied from the paper feeding path SH1 of the paper feeding apparatus U2 is conveyed to the paper feeding path SH2 by the conveying roll Ra serving as an example of a medium conveying member. Then, the recording paper S is conveyed to the secondary transfer area Q4 through a medium guide member SGr and a pre-transfer guide member SG1 in synchronization with the conveyance of a toner image to the secondary transfer area Q4.

The medium guide member SGr is fixed to and supported by the image forming apparatus body U3 together with a registration roll Rr.

A toner image on the intermediate transfer belt B is transferred onto the recording paper S by the secondary transfer device T2 when intermediate transfer belt B passes through the secondary transfer area Q4. In the case of forming a full color image, toner images superposed on the surface of the intermediate transfer belt B by primary transfer are collectively transferred onto the recording paper S by secondary transfer.

After the secondary transfer, the intermediate transfer belt B is cleaned by the belt cleaner CLB serving as an example of an intermediate transfer body cleaning device. The secondary transfer roll T2*b* and the belt cleaner CLB are supported to be separable from and contactable with the intermediate transfer belt B.

The recording paper S onto which the toner images are transferred by the secondary transfer is conveyed to a fixing device F through the post-transfer guide member SC2 and a paper conveying belt BH serving as an example of a pre-fixing conveying member. The fixing device F has a heating roll Fh serving as an example of a heating/fixing member, and a pressure roll $F_P$ serving as an example of a heating/fixing member. A fixing area Q5 is the area in which the heating roll Fh and the pressure roll $F_p$ are press-contacted with each other.

The toner images on the recording paper S are heated and fixed by the fixing device F when passing through the fixing area Q5. A conveyance path switching member GT1 is provided downstream of the fixing device F. The conveyance path switching member GT1 selectively switches a path for conveying the recording paper S which is conveyed on the paper conveying path SH2 and heated and fixed in the fixing area Q5, to either the paper discharge path SH3 of the paper processing device U4 or the paper inverting path SH4. The recording paper S conveyed to the paper discharge path SH3 is conveyed to a paper conveying path SH5 of the paper processing device U4.

A curl correction device U4*a* serving as an example of a curl correction device is arranged at a position along the paper conveying path SH5. A switching gate G4 serving as an example of the conveying path switching member is provided on the paper conveying path SH5. The switching gate G4 conveys the recording paper S, which is conveyed from the paper conveying path SH3 of the image forming apparatus body U3, to either a first correction member h1 or a second correction member h2 according to the direction of the curl. The curl of the recording paper S conveyed to the first correction member h1 or the second correction member h2 is corrected when it passes through the correction member. The recording paper S whose curl is corrected is discharged to a discharge tray TH1 serving as an example of the discharge portion of the paper processing device U4 from a discharge roll Rh serving as an example of a discharge member in a state in which the image fixed surface of the paper is upwardly directed, i.e., in what is called a faceup state.

The recording paper S conveyed to the paper inverting path SH4 of the image forming apparatus body U3 by the conveyance path switching member GT1 pushes away a conveyance restraining member including an elastic thin film member, i.e., what is called a Mylar gate GT2 to thereby pass therethrough. Thus, the recording paper S is conveyed to the paper inverting path SH4.

The paper circulation path SH6 and a paper inverting path SH7 are connected downstream of the paper inverting path SH4 of the image forming apparatus body U3. A Mylar gate GT3 is arranged at the connection portion. The recording paper S conveyed to the paper inverting path SH4 through the switching gate GT1 passes through the Mylar gate GT3 and is conveyed to the paper inverting path SH7 of the paper processing device U4. In the case of performing two-side printing, the recording paper S conveyed through the paper inverting path SH4 passes through the Mylar gate GT3 unchanged and is conveyed to the paper inverting path SH7. Then, the paper S is conveyed in the opposite direction, i.e., is subjected to what is called a switchback. Subsequently, the direction of conveying the recording paper S is limited by the Mylar gate GT3. The recording paper S switched back is conveyed to the paper circulating path SH6. The switched-back recording paper S is conveyed to the paper circulating path SH6 and is sent again to the transfer area Q4 via the paper feeding path SH1.

On the other hand, when the recording paper S conveyed to the paper inverting path SH4 is switched back after the rear edge of the recording paper S passes through the Mylar gate GT2 and before the rear edge thereof passes through the Mylar gate GT3, the direction of conveying the recording paper S is limited by the Mylar gate GT2. Thus, the recording paper S is conveyed to the paper conveying path SH5 in a state, in which the front and the back of the recording paper S are inverted. Then, the curl of recording paper S with the front and the back inverted is corrected by the curl correction device U4*a*. Then, the recording paper S can be discharged to the paper discharge tray TH1 of the paper processing device U4 in a state in which the image fixing surface of the recording paper S is directed downwardly, i.e., in what is called a facedown state.

The paper conveying path SH includes components designated with reference numerals SH1 to SH7. A medium conveying apparatus SU includes components respectively designated with reference numerals SH, Ra, Rr, Rh, SGr, SG1, SG2, BH, and GT1 to GT3.

(Description of Manufacturing Method for Endless Belt-Shaped Body)

Hereinafter, a method of manufacturing the intermediate transfer belt B serving as an example of the endless belt-shaped body used in the image forming apparatus U according to Embodiment 1 of the invention, i.e., the endless belt is described below.

According to Embodiment 1, from the viewpoint of strength, dimension stability, and heat resistance, a polyimide resin PI or a polyamide resin PAI are employed as the coating film forming resin. Various known PI and PAI resins can be used. In the case of PI, precursors of PI can be applied as the coating film forming resin.

PI precursor solution can be obtained by causing a tetracarboxylic acid dianhydride and a diamine component to react in a solvent. The type of the component is not limited to a specific one. However, from the viewpoint of the strength of the coating film, a compound obtained by causing an aromatic tetracarboxylic dianhydride and an aromatic diamine component to react is desirable.

Typical examples of the aromatic tetracarboxylic acid include pyromellitic dianhydride, 3,3',4,4'-biphenyltetracarboxylic dianhydride, 3,3',4,4'-benzophenonetetracarboxylic dianhydride, 2,3,4,4'-biphenyltetracarboxylic dianhydride, 2,3,6,7-naphthalenetetracarboxylic dianhydride, 1,2,5,6-naphthalenetetracarboxylic dianhydride, 2,2-bis(3,4-dicarboxyphenyl)ether dianhydride, tetracarboxylic esters thereof, and mixtures of any of the above tetracarboxylic acids.

On the other hand, examples of the aromatic diamine component are para-phenylenediamine, meta-phenylenediamine, 4,4'-diaminodiphenyl ether, 4,4'-diaminophenylmethane, benzidine, 3,3'-dimethoxybenzidine, 4,4'-diaminodiphenylpropane and 2,2-bis[4-(4-aminophenoxy)phenyl]propane.

On the other hand, PAI is obtained by combining an acid anhydride, e.g., a trimellitic acid anhydride, an ethylene glycol bis-(anhydro-trimellitate), a propylene glycol bis-(anhydro-trimellitate), a pyromellitic anhydride, a benzophenone-tetra-carboxylic anhydride, a 3,3',4,4'-biphenyltetracarboxylic anhydride, or the like with one of the above diamines in an equimolar amount and causing a polycondensation reaction. Because PAI has an amide group, PAI easily dissolves into a solvent even when an imidization reaction proceeds. Accordingly, 100% imidized PAI is desirable.

An aprotic polar solvent, such as N-methylpyrrolidone, N,N-dimethylacetamide, or acetamide, is used as the solvent (solvent A) therefor. The concentration and the viscosity of the solution are appropriately selected. However, in both the inner and outer layers, the desirable concentration of solid content of the solution ranges from 10 percent by mass to 40 percent by mass. The desirable viscosity ranges from 1 Pa·s to 100 Pa·s.

The materials of electrically conductive particles dispersed in the resin solution are, e.g., carbon-based materials such as carbon black, carbon fiber, carbon nanotube, and graphite, metal or alloy materials such as copper, silver, and aluminum, electrically conductive metal oxides such as tin oxide, indium oxide, and antimony oxide, whisker materials such as potassium titanate, and also barium sulfate, titanium oxide, and zinc oxide. Among these materials, particularly, carbon black is desirable from the viewpoints of the stability of dispersion in the solution, ease of generation of semiconductivity, and the price.

Known devices, such as a ball mill, a sand mill (bead mill), and a jet mill (direct collision type disperser), can be employed as the dispersion method. In addition, a surface active agent or a leveling agent can be added as a dispersion accelerating agent. Preferably, the dispersion density of electrically conductive particles ranges from 10 parts (parts by mass (hereunder similarly referred to simply as parts)) to 40 parts, more preferably, 15 parts to 35 parts with respect to 100 parts of resin components.

Figure 3:
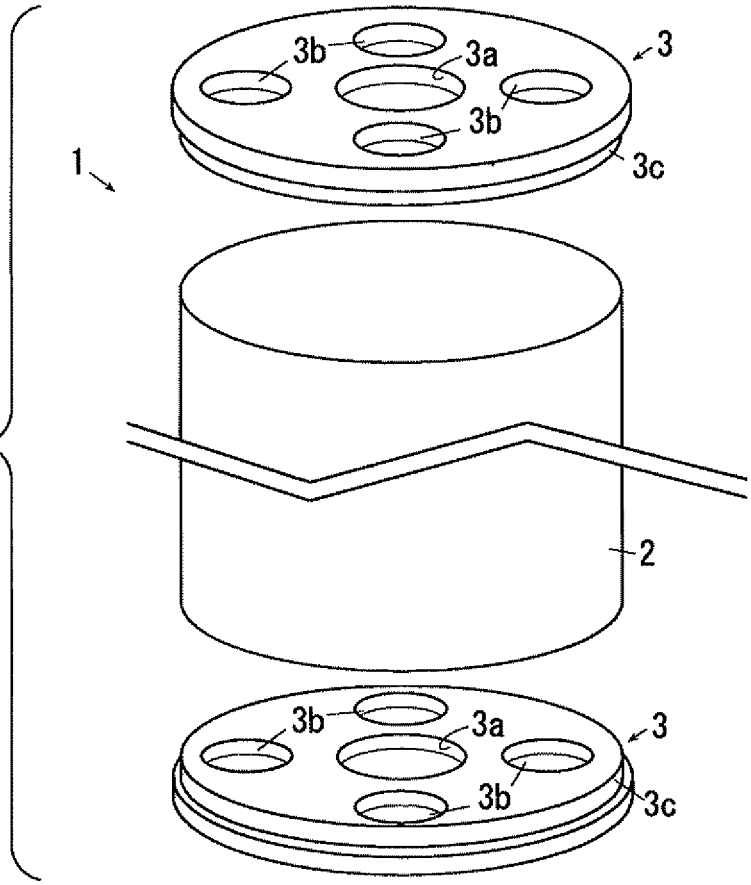
FIG. 3 is an explanatory view illustrating an entire cylindrical core according to Embodiment 1.

FIG. 3 is an explanatory view illustrating the entire cylindrical core according to Embodiment 1.

Figure 4:
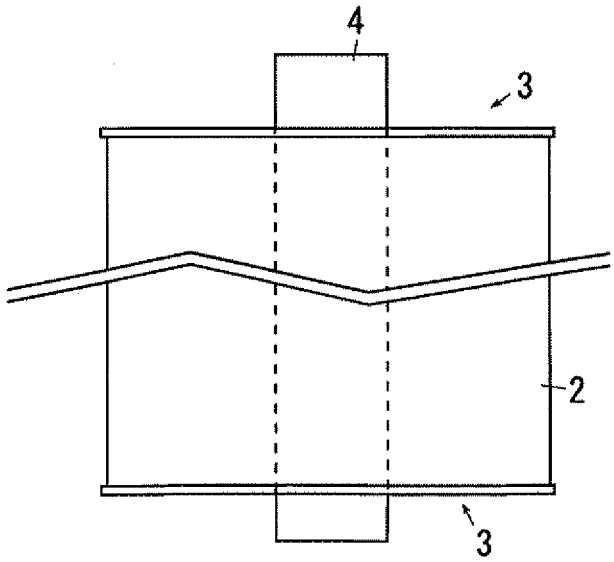
FIG. 4 is an explanatory view illustrating a state in which a rotating shaft is mounted in the cylindrical core.

FIG. 4 is an explanatory view illustrating a state in which a rotating shaft is mounted in the cylindrical core.

Next, the cylindrical core is described hereinafter.

As illustrated in FIG. 3, a cylindrical core 1 has a thin metallic cylindrical portion 2 serving as an example of a thin cylinder, and flanges 3 serving as examples of flange portions detachably mountable at both axial end portions of the cylindrical portion 2.

Metal, such as aluminum, stainless steel, and nickel, can be used as the material of the cylindrical portion 2. A length of the cylindrical core longer than that of endless belt is needed. Further, to assure adequate size accounting for unusable areas generated at each end portion, preferably, the length of the cylindrical core is longer than that of the target endless belt by about 10% to 40%.

The behavior of the cylindrical portion 2 in response to change in the shape thereof greatly changes depending on the relationship between the thickness and the diameter of the cylindrical portion 2. When two 1-mm-thick cylindrical portions to be employed as the cylindrical portion 2, whose diameters are 300 mm and 30 mm, are compared with each other, the cylindrical portion 2 having a diameter of 300 mm cannot maintain its cylindrical shape unsupported in a state in which the axial direction of the cylindrical portion 2 is perpendicular to the direction of gravitational force. However, the cylindrical portion 2 having a smaller diameter of 30 mm can maintain its cylindrical shape unsupported.

Preferably, the thickness of the cylindrical portion 2 is sufficiently thin with respect to the diameter of the cylindrical portion. More specifically, it is preferable that the thickness of the cylindrical portion 2 is equal to or less than 1/100 the diameter thereof. That is, preferably, the cylindrical portion 2 is a metal belt that cannot maintain (can change) its cylindrical shape unsupported in a state in which the axial direction of the cylindrical portion 2 is perpendicular to the direction of gravitational force. When the thickness of the cylindrical portion 2 is this thin in comparison with the diameter thereof, the thermal energy used during the heating of the cylindrical portion 2 is extremely low compared with where the cylindrical portion 2 is a cylinder that can maintain (does not change) its cylindrical shape unsupported in a state in which the axial direction of the cylindrical portion 2 is perpendicular to the direction of gravitational force. In addition, the time required to increase temperature is short. Consequently, energy-saving can be achieved.

However, when the thickness of the cylindrical portion 2 is reduced to such an extent with respect to the diameter thereof, the cylindrical portion 2 cannot maintain its cylindrical shape unsupported in a position where the cylindrical portion 2 is pulled down by its own weight, that is, the axial direction of the cylindrical portion 2 is perpendicular to the direction of gravitational force. Consequently, troubles are caused when it coated. This phenomenon becomes more pronounced as the diameter of the cylindrical portion 2 increases. This is because the thickness of an actually usable cylindrical portion 2 is limited within a certain range from the viewpoint of energy-saving.

In order to deal with this problem, according to Embodiment 1, the flanges 3 are attached to both ends of the cylindrical portion 2. As illustrated in FIGS. 3 and 4, each of the flanges 3 according to Embodiment 1 is formed like a disk. Each of the flange portions 3 can be made of a metal material or a thermally-resistant resin material. Preferably, each of the flange portions 3 is made of a metal material having a thickness of about 2 mm to 20 mm. An axial through hole 3*a*, in which a rotating shaft 4 is detachably mounted, is formed in the central portion of each of the flanges 3. Four ventilation holes 3*b* are formed in each of the flanges 3, provided at positions along four directions from the axial through hole 3*a*.

Figure 5A:
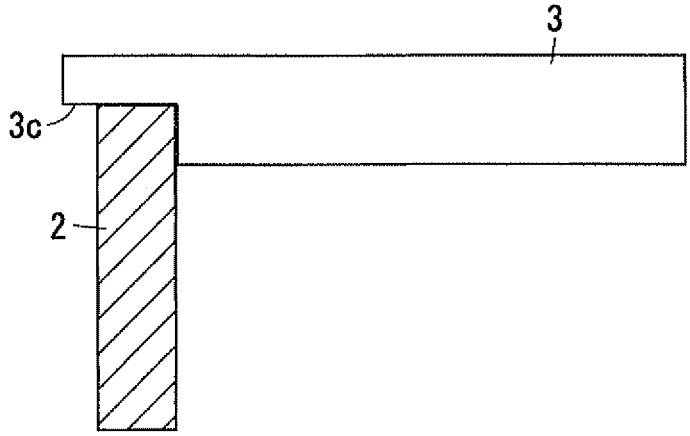
FIGS. 5A and 5B are explanatory views each illustrating primary parts of a cylindrical portion and of a circumferential edge portion of a flange of the cylindrical core according to Embodiment 1.
Figure 5B:
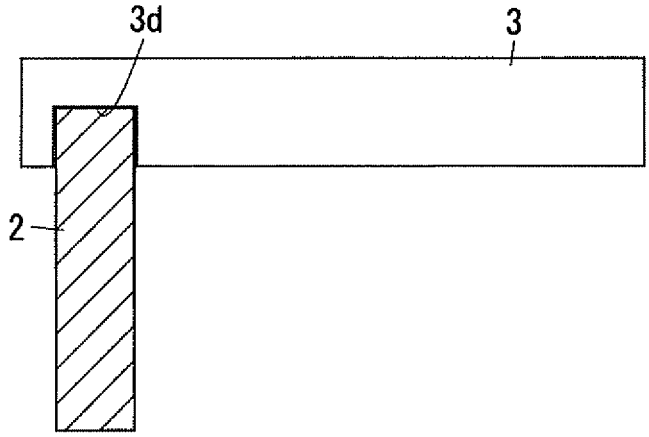

FIGS. 5A and 5B are explanatory views each illustrating important parts of the cylindrical portion and the circumferential edge portions of the flanges according to Embodiment 1. FIG. 5A is an explanatory view illustrating a configuration in which the cylindrical portion is fit into a step of the circumferential edge portion of the flange. FIG. 5B is an explanatory view illustrating a configuration in which the cylindrical portion is fit into a circumferential groove of the flange.

As illustrated in FIGS. 3 and 5A, a step 3*c* to be positioned at and fit to the cylindrical portion 2 is formed along the outer circumferential portion of each of the flanges 3 according to Embodiment 1. Preferably, the inner diameter of the step 3*c* is slightly smaller than the inside diameter of the cylindrical core. Accordingly, according to Embodiment 1, the cylindrical core is configured by fitting the cylindrical portion 2 detachably to each of the flanges 3, instead of integrally joining the cylindrical portion 2 and the flanges 3 by, e.g., welding. The method of configuring the cylindrical portion 2 and the flanges 3 according to the invention is not limited to the method using the step part 3*c*. The cylindrical portion 2 and each of the flanges 3 can be configured by forming an annular groove 3*d* as illustrated in FIG. 5B so that the cylindrical portion 2 is fit into each of the flanges 3. In addition, the configuration of the cylindrical core is not limited to that using such fitting. The cylindrical portion 2 can be detachably attached to each of the flanges 3 using attachment tools, such as screws.

As illustrated in FIG. 3, preferably, ventilation holes 3*b* are provided in each of the flanges 3. However, the ventilation holes 3*b* can be omitted. The ventilation holes 3*b* serve as what are called lightening holes and contribute to the reduction in weight of the flanges.

As will be described below, the flanges 3 according to Embodiment 1 are attached to the cylindrical portion 2 when it is coated and dried while being rotated. When the cylindrical core is put into a heating furnace, the flanges 3 are removed from the cylindrical portion 2.

The PI resin has a property that when a precursor thereof is heated for a reaction, gas is frequently generated. A PI resin coating film is liable to be partly expanded. This phenomenon becomes pronounced especially when the film thickness of the coating film exceeds 50 μm. Gas which is generated when the precursor is heated for a reaction includes volatile gas generated from a residual solvent and water vapor generated when the precursor reacts.

In order to prevent the coating film from being expanded, preferably, a surface of the cylindrical portion 2 is roughened to the extent that the arithmetic average of roughness Ra ranges from 0.2 μm to 2 μm. This is because when the arithmetic average of the roughness Ra is less than 0.2 μm, it is difficult for gas such as the volatile gas or the water vapor to escape, and when the arithmetic average of the roughness Ra is larger than 2 μm, unevenness is formed on a surface of the manufactured endless belt. The roughening method is, e.g., blasting, cutting, and sandpapering. Consequently, gas generated from a PI resin can be discharged through a narrow gap formed between the cylindrical portion 2 and the PI resin coating film, so that no expansion of the coating film is caused.

The resin solution is applied onto the cylindrical portion 2 by an appropriate application method. When the resin solution is applied thereto, the flanges 3 are fixed to the cylindrical portion 2 by being fit thereto. That is, the cylindrical portion 2, which cannot maintain its shape unsupported, is constructed with the flanges 3 attached to the cylindrical core 1 so as to be able to maintain its cylindrical shape even when tilted or toppled over. According to Embodiment 1, the rotating shaft 4 is mounted in the axial through hole 3*a* of each of the fixed flanges 3.

Figure 6:
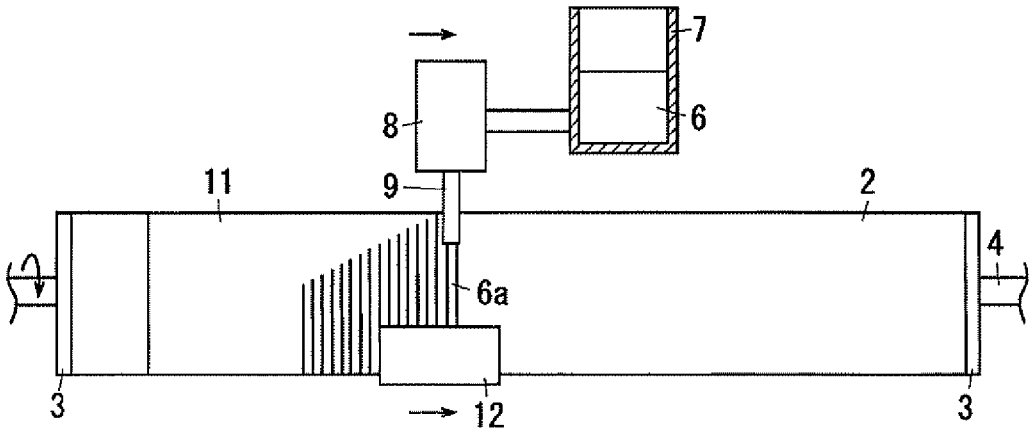
FIG. 6 is an explanatory view illustrating a method of applying a coat forming resin solution to an outer surface of the cylindrical portion according to Embodiment 1.

FIG. 6 is an explanatory view illustrating a method of applying the coating film forming resin solution according to Embodiment 1 onto an outer surface of the cylindrical portion 2.

As illustrated in FIG. 6, what is called a spiral application method of setting the axial direction of the cylindrical portion 2 to be horizontal, then rotating the cylindrical portion 2, and making the resin solution adhere to a surface of the cylindrical portion 2 by dropping the resin solution thereonto is favorable as the method of application of the resin solution. That is, as illustrated in FIG. 6, a pump 8 serving as an example of a drive device is connected to a container 7 containing the coating film forming resin solution 6. A nozzle 9 serving as an example of an application portion is connected to the pump 8. The pump 8 discharges a preset amount of a solution 6 from the nozzle 9. The nozzle 9 is supported movably in the axial direction of the cylindrical core 1 in a state in which the nozzle 9 is close to the outer surface of the cylindrical portion 2. The coating film forming resin solution 6 is discharged in a state in which the cylindrical core 1 is rotated at a preset speed of rotation, while the nozzle 9 is moved in the axial direction of the cylindrical core 1. Thus, a coating film 11 is formed by helically applying the coating film forming resin solution 6*a* onto the surface of the cylindrical portion 2. Then, a blade 12 serving as an example of a smoothing unit is pushed against the coated film 11 and moved in the axial direction of the cylindrical core 1 while the rotating core 1 is rotated. Thus, the spiral line formed on the surface of the cylindrical portion is erased, so that a seamless coating film 11 is formed.

Figure 7:
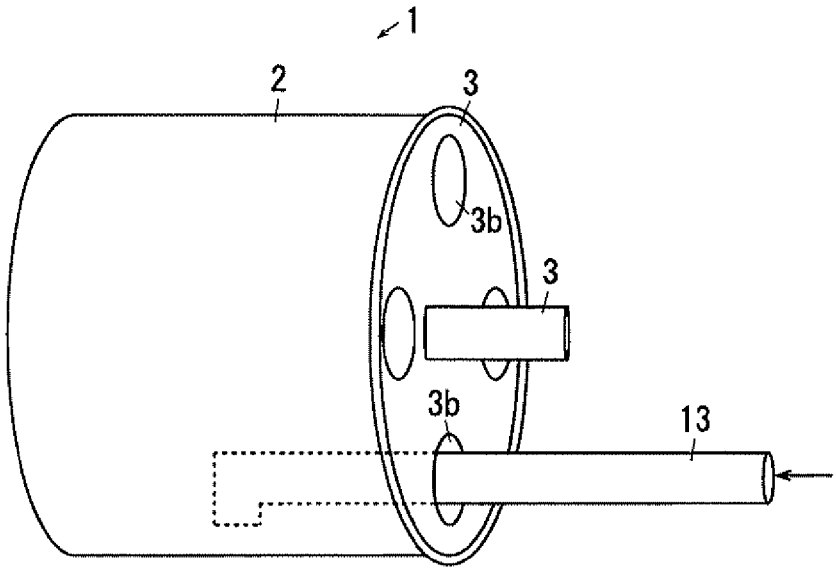
FIG. 7 is an explanatory view illustrating another method of applying the coat forming resin solution to the outer surface of the cylindrical portion according to Embodiment 1.

FIG. 7 is an explanatory view illustrating a method of applying the coating film forming resin solution according to Embodiment 1.

As illustrated in FIG. 7, the following method can be performed as another coating method. That is, a nozzle 13 for coating the inner surface is inserted from the ventilation hole 3*b* into the cylindrical portion. Then, the coating film forming resin solution is injected onto the inner surface of the cylindrical portion 2. More specifically, after a certain amount of the solution is discharged and injected onto the inner surface of the cylindrical portion 2, the cylindrical core 1 is rotated at high speed around the rotating shaft 3. Thus, the solution is spread on the inner surface of the cylindrical portion 2 by centrifugal force. Consequently, a coating film can be formed. That is, a uniform coating film is formed on the inner surface thereof by a centrifugal molding method. The cylindrical core 1 can be rotated slowly after the uniform coating film is formed.

Figure 8:
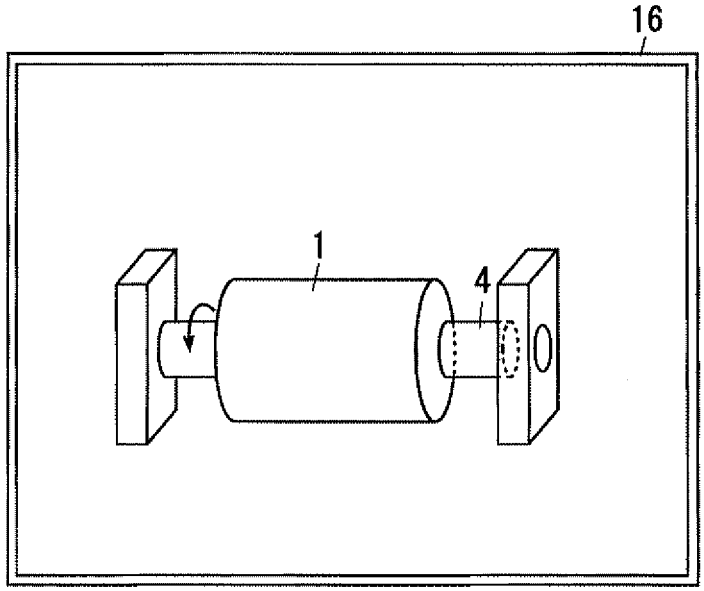
FIG. 8 is an explanatory view illustrating a drying step according to Embodiment 1.

FIG. 8 is an explanatory view illustrating a drying step according to Embodiment 1.

In order to prevent the coating film from dripping down after being applied, the cylindrical core 1 is heated in a drying furnace, while being rotated at from about 5 revolutions per minute (rpm) to 6 rpm, as illustrated in FIG. 8. Thus, first, a solvent for the coating film is dried. Preferably, heating conditions are set such that the heating temperature ranges from 90° C. to 170° C., and that the heating time ranges from 30 minutes to 60 minutes. Here, the higher the temperature is, the shorter the heating time can be. It is effective to blow hot wind on to the corer in addition to the heating of the core. During the heating, the temperature can be raised in stages or at a constant rate.

Figure 9:
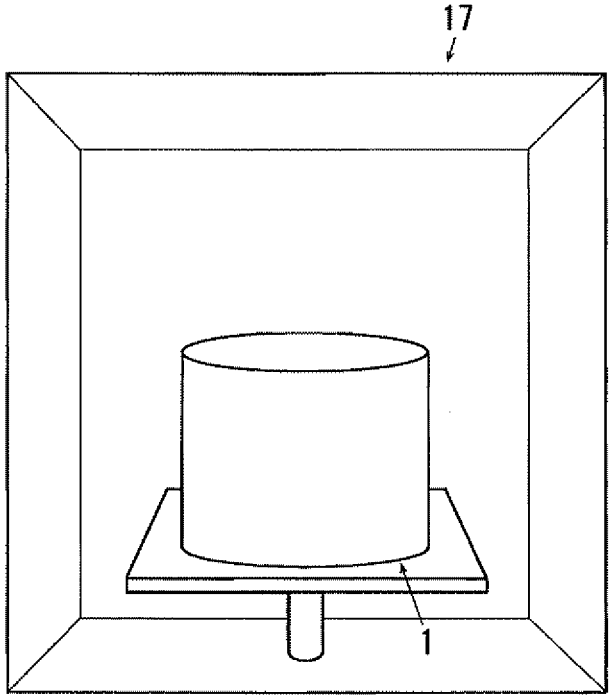
FIG. 9 is an explanatory view illustrating a heating step according to Embodiment 1.

FIG. 9 is an explanatory view illustrating a heating step according to Embodiment 1.

After the coating film stops dripping, the flanges 3 and the rotating shaft 4 are removed from the cylindrical portion 2 of the cylindrical core 1. Then, the cylindrical portion 2 is erected so as to set the axis in the vertical direction. As illustrated in FIG. 9, the cylindrical portion 2 is put into a heating furnace 17 and heated therein.

When the inner surface of the cylindrical portion 2 is coated, even if the cylindrical portion 2 is heated without changes, the flanges 3 can be removed from the cylindrical portion 2, and the dried coating film on the inner surface thereof can be peeled off and then fit around an outer surface of another cylindrical core. In this case, the outside diameter of the latter cylindrical core is made less than the inside diameter of the cylindrical portion 2 used for coating.

Preferably, the heating temperature ranges from about 250° C. to 450° C. More preferably, the heating temperature ranges from about 300° C. to 350° C. The PI precursor coating film is heated 20 minutes to 60 minutes at such temperature. Thus, an imidization reaction is caused. Consequently, a PI resin coating film is formed. Preferably, at a heating reaction, the cylindrical portion 2 is heated by raising the heating temperature in stages or gradually at a constant rate before the heating temperature reaches a final temperature.

In the case of using PAI as a coating film resin, a coating film is formed only by drying the solvent.

Upon completion of heating the cylindrical portion 2, the cylindrical portion 2 is taken out of the heating furnace 17. The formed coating film is extracted from the cylindrical portion 2. At that time, the cylindrical portion 2 is deformable. Thus, the coating film can be drawn out while the cylindrical portion 2 is deformed.

The end portions of the obtained coating film have defects such as unevenness of the film thickness thereof. Thus, unnecessary parts are cut out, and thus an endless belt B is obtained. If necessary, hole-drilling, ribbing, and the like can be performed on the endless belt B.

Accordingly, the endless belt B manufactured by the foregoing manufacturing method is such that the flanges 3 can be attached to and detached from the cylindrical portion 2. Temperature unevenness caused at the heating of the cylindrical portion 2 is reduced by removing the flanges 3 when the cylindrical portion 2 is put into the heating furnace 17. Consequently, electrical resistance unevenness of the endless belt B manufactured using the cylindrical core 1 can be reduced to a very small value. Even when the endless belt is used as the intermediate transfer belt B, the transferability of toner is uniform and favorable. In a case where the flanges 3 are not removed when the cylindrical portion 2 is put into the heating furnace 17 similarly to the case of performing the above manufacturing method, temperature unevenness at the heating of the cylindrical portion is increased. The larger the diameter of the cylindrical portion 2, the more pronounced the temperature unevenness. Similarly, the larger the diameter of the cylindrical portion 2, the larger the variation in the electrical resistance of the endless belt B manufactured using the cylindrical core 1.

In the cylindrical portion 2 which is constituted by a metal belt, which cannot maintain its cylindrical shape unsupported (i.e., is deformable) in a state in which the axial direction of the cylindrical portion 2 is perpendicular to the direction of gravitational force, the thermal capacity is small, the temperature rises quickly, and the necessary amount of heat, i.e. energy, is small, so that energy saving is achieved, as compared with cases where the cylindrical portion 2, and where the cylindrical portion 2 is constituted by a metal belt whose cylindrical shape maintainable unsupported (i.e., undeformable) even in a state in which the axial direction of the cylindrical portion 2 is perpendicular to the direction of gravitational force.

Next, the following experiments were performed in order to confirm the advantages of Embodiment 1.

Experimental Example 1

In Experimental Example 1, a cylinder made of SUS 304 stainless steel, which was 600 mm in outer diameter, 1.2 mm in thickness, and 900 mm in length, was prepared as the cylindrical portion 2. This cylinder was obtained by rounding and welding a plate having a thickness of 1.2 mm. Grinding was sufficiently performed on the seam to thereby eliminate the line and step. This cylindrical portion had a thickness that was sufficiently small with respect to an outside diameter. Thus, the cylindrical portion 2 deformed by its own weight and could not maintain its cylindrical shape unsupported. A surface of the cylindrical portion 2 was roughened by being subjected to blasting with spherical alumina particles so that the roughness Ra was 0.4 μm.

A silicone-based mold release agent (trade name: SEPA-COAT® manufactured by Shin-Etsu Chemical Co., Ltd.) was applied by spraying on the surface of the cylindrical portion 2. Then, the cylindrical portion 2 was put into a heating furnace and heated 1 hour at 300° C. Thus, the agent was baked on.

Figure 10A:
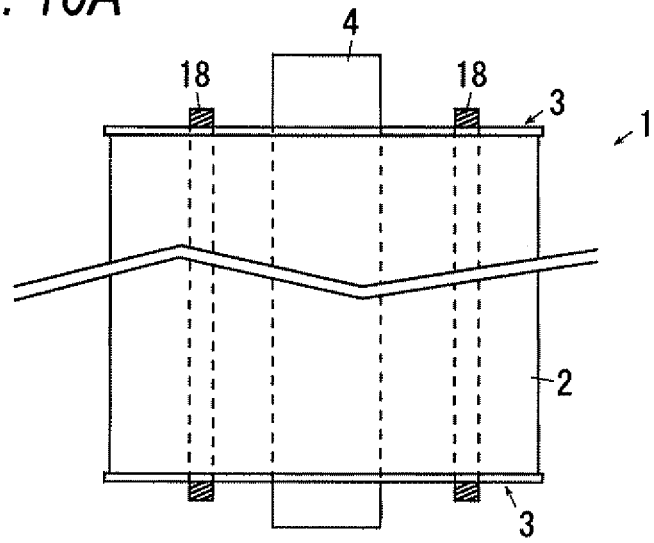
FIGS. 10A and 10B are explanatory views each illustrating the cylindrical core used in Experimental Example 1.
Figure 10B:
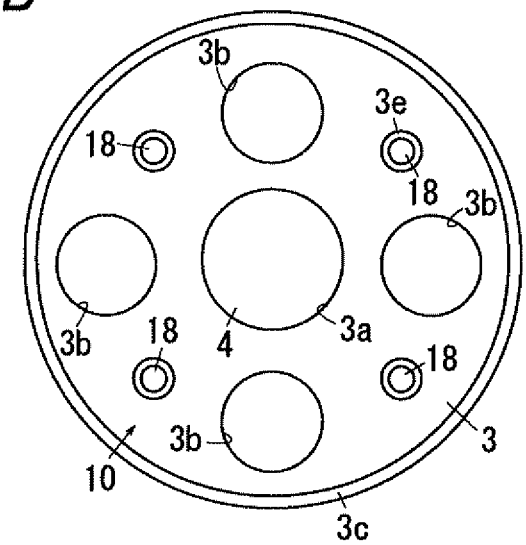

FIGS. 10A and 10B are explanatory views each illustrating a cylindrical core used in Experimental Example 1. FIG. 10A is a side view thereof. FIG. 10B is a plan view thereof.

A member made of the same SUS stainless steel material, which had a shape illustrated in FIGS. 3 and 5A and which was 8 mm in thickness, and 600 mm in diameter, and was manufactured as the flange 3, which was provided with four ventilation holes each having a diameter of 100 mm. The inner outside diameter of the step 3*c* illustrated in FIG. 5A was set at 597.6 mm. In Experimental Example 1, as illustrated in FIG. 10B, four screw holes 3*e* were formed, each between two adjacent ventilation holes 3*b*, in each of the flanges 3. After the flanges 3 were fit to the cylindrical portion 2, the upper and lower flanges 3 were fixed by tie-rods 18 extending along the axis thereof. Both ends of each of the tie-rods 18 were threaded. Each of the tie-rods 18 could be attached to and detached from each of the flanges 3 by being fit into and out of one of the screw holes 3*e*. A rotating shaft 4, which was 120 mm in outside diameter and 100 mm in length, was mounted in the axial through hole 3*a* of each of the flanges 3.

On the other hand, carbon black (trade name: Special Black 4 manufactured by Degussa-Huls Corporation) was mixed into PI precursor solution (trade name: U-Varnish manufactured by UBE industries, Ltd., concentration of solid content was 18%, and solvent was N-methyl pyrolidone) so that a solid content mass ratio was 29%. Then, carbon black was dispersed by an direct collision type disperser ("GEANUS PY" manufactured by Geanus Corporation) to thereby obtain coating liquid whose viscosity was about 45 Pa·s at 25° C.

Then, a PI precursor coating film was formed by a spiral coating apparatus illustrated in FIG. 6 using the above coating liquid.

Coating was performed as follows. A Mono pump 8 was connected to a container 7 which contained PI precursor coating liquid 6. Then, the liquid was discharged from a nozzle 9 at a rate of 20 ml per minute. A coating film was formed from a position 40 mm from one end of the cylindrical core 1 to a position 40 mm from the other end.

A blade 12 serving as a smoothing unit used in Experimental Example 1 was obtained by processing a stainless steel plate having a thickness of 0.2 mm such that a width was 20 mm, and that a length was 50 mm.

The cylindrical core 1 was rotated in the direction of rotation A at a rate of 60 rpm. The discharged liquid 6 adhered to the core 1. Subsequently, the blade 12 was pushed toward the surface of the core 1. Then, the blade 12 was moved in the axial direction B of the core 1 at a speed of 210 mm per minute. Consequently, the spiral line formed on the surface of the coating film 11 was caused to disappear. At an edge of the coating film 11, the blade 12 was retreated by 50 mm to prevent the blade 12 from contacted directly with the surface.

Consequently, the coating film 11 having a wet film thickness of about 600 μm was formed on the surface of the cylindrical core 1. Subsequently, the core 1 was put into a drying furnace 16 having a temperature of 135° C. while being rotated at a rate of 10 rpm. Then, the core 1 was dried 25 minutes. Accordingly, a coating film 11 was obtained in which the amount of residual solvent in the inside and outside coating film was 40 percent by weight, and that the coating film and which did not sag even when the core 1 rotation was stopped, and it was erected vertically.

Subsequently, the cylindrical core 1 was unloaded from a rotating table (not shown) of the drying furnace 16. The axis of the cylindrical core 1 was set to be vertical. The flanges 3 were removed from the cylindrical portion. Then, the cylindrical portion 2 was put into the heating furnace 17 and heated. The cylindrical portion 2 was heated 30 minutes at 200° C. and then 30 minutes at 300° C. to cause a reaction.

Figure 11:
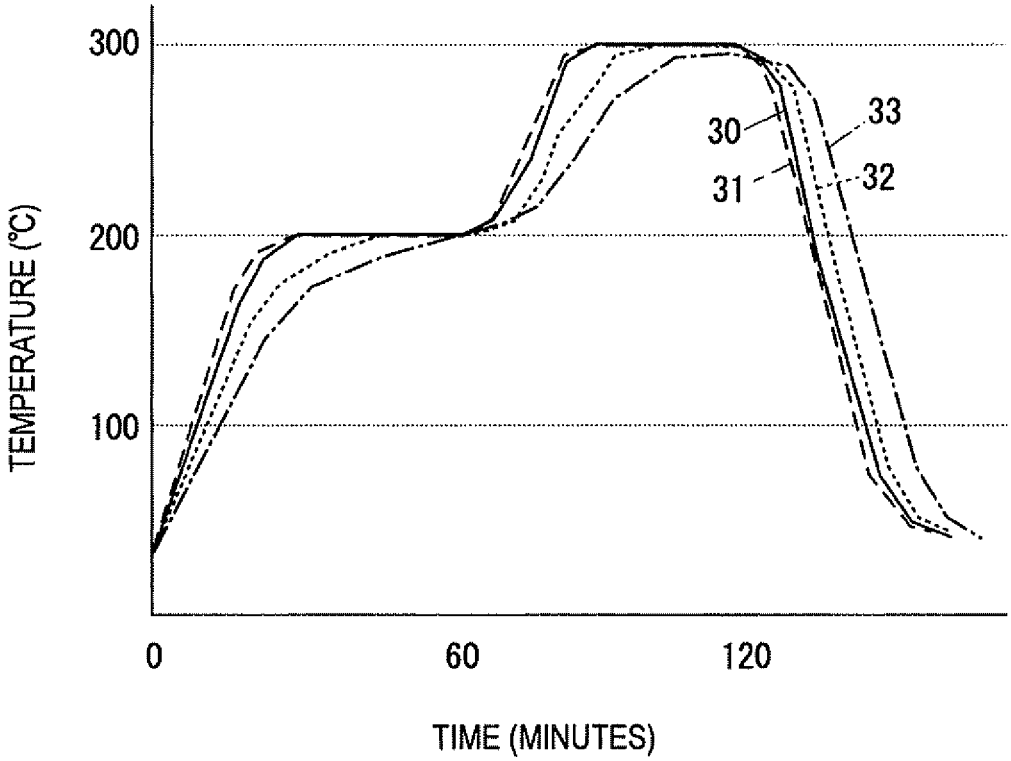

FIG. 11 is a graph illustrating results of measurement of the temperature of the cylindrical core after the core was heated by the heating furnace in Experimental Example 1. The abscissa represents time. The ordinate represents temperature.

At that time, the temperature of the cylindrical core 1 was measured. The measurement positions were at the inner side of a central portion in the axial direction of the cylindrical core 1, and at the inner side of a portion at a distance of 120 mm from an end of the cylindrical core 1, i.e., a position corresponding to an end portion in the axial direction of the endless belt. FIG. 11 illustrates results of the measurement.

As is seen from FIG. 11, a temperature rise curve 30 representing the rise of temperature at the position corresponding to the central portion, and a temperature rise curve 31 representing the rise of temperature at the position corresponding to the portion at a distance of 120 mm from the end portion were substantially the same. That is, it was confirmed that there was very small temperature unevenness along the axis of the cylindrical core 1.

After the temperature of the cylindrical portion 2 was lowered to room temperature, the resin film was removed from the cylindrical portion 2. Thus, an endless belt was obtained. This endless belt was cut along the center. In addition, unusable parts extending from both ends thereof were cut off. Consequently, two endless belts B each having a width of 360 mm were obtained. The film thickness of each of the endless belts B measured using a dial gauge was about 80 μm.

Comparative Example 1

In the case of Comparative Example 1, when the cylindrical core 1 was put into the heating furnace 17, the flanges 3 were also put thereinto without being removed from the cylindrical core. At that time, the temperature of the cylindrical core 1 was measured. FIG. 11 illustrates results of this measurement. The measurement positions in this case were the same as those in the case of Experimental Example 1.

As is seen from FIG. 11, a temperature rise curve corresponding to a central portion in the case of Comparative Example 1 was the same as the temperature rise curve 30 corresponding to the central portion in the case of Experimental Example 1. However, as is seen from FIG. 11, a temperature rise curve 32 corresponding to a position at a distance of 120 mm from an end portion shows a result that the rise of temperature was considerably delayed. This is due to the influence of the fact that the flanges 3 attached to the ends of the core 1 increase thermal capacity at the ends thereof.

Comparative Example 2

In the case of Comparative Example 2, a cylinder made of SUS 304 stainless steel, which was 600 mm in outer diameter, 10 mm in thickness, and 900 mm in length, was prepared as the cylindrical portion 2. This cylinder was obtained by rounding and welding a plate having a thickness of 10 mm. Grinding was sufficiently performed on the seam to eliminate the line and step. The cylindrical portion 2 was sufficiently thick with respect to an outside diameter so that the cylindrical portion 2 did not deform under its own weight and could maintain a cylindrical shape unsupported. Consequently, flanges 3 were unnecessary. Similarly to Experimental Example 1, a surface of the cylindrical portion 2 was roughened by blasting with spherical alumina particles so that the roughness Ra thereof was 0.4 μm. A mold release agent was applied to the surface of the cylindrical portion 2.

Coating and drying were performed using the cylindrical portion 2, as in Experimental Example 1. The rotation of the cylindrical portion 2 was performed by employing a method of sandwiching both sides of the cylindrical portion 2 by jigs. Subsequently, the axis of the cylindrical portion 2 was set to be vertical. Then, the cylindrical portion 2 was put into the heating furnace 17 so as to raise the temperature of the cylindrical portion 2. The cylindrical portion 2 was heated 50 minutes at 200° C., and then 30 minutes at 300° C.

At that time, the temperature of the cylindrical portion 2 was measured. FIG. 11 illustrates results of this measurement. The measurement positions were the same as those in the case of Experimental Example 1. The temperature rise curve of the central portion and the temperature rise curve of the position at a distance of 120 mm from an end in the case of Comparative Example 2 were the same, the temperature rise curve 33. Compared with the cases of Experimental Example 1 and Comparative Example 1, the temperature rise was delayed. This is because of the facts that the thickness of the cylindrical portion 2 was great, so that the thermal capacity of the entire cylindrical portion 2 was high and the temperature was difficult to raise. Thus, the thermal chemical reaction was not completed normally. In order to obtain temperature similar to that in the case of Embodiment 1, it was necessary for the cylindrical portion 2 to be heated at high temperature for a long time. Specifically, the cylindrical portion 2 was heated 50 minutes at 200° C., and then 30 minutes at 300° C. Consequently, Comparative Example 2 has the problem that more time and energy are needed.

Next, the electric characteristics of Experimental Example 1 and Comparative Example 1 were measured.

(Surface Resistivity)

A surface resistivity is defined as a value obtained by dividing an electrical potential gradient in a direction parallel to that of electric current flowing along a surface of a test specimen by the magnitude of electric current per unit width of the surface. The surface resistivity is equivalent to the surface resistance between two electrodes in a case where the two electrodes are opposite sides of a square each side of which is 1 cm. Formally, the unit of the surface resistivity is ohm (Ω). However, the unit of the surface resistivity is described as Ω/□ in order to be distinguished from mere resistance.

Measurement of the surface resistivity was performed using a digital ultrahigh-resistance/minute-current ammeter (R8340A manufactured by Advantest Corporation), a "UR probe" MCP-HTP12 having a double-ring-electrode structure whose connection part has been modified exclusively for R8340A, and a Resitable UFL MCP-ST03 (both of which are manufactured by Dia Instruments, Co. Ltd.), which conform to Japanese Industrial Standards (JIS) K6911 (1995).

For the measurement, a test piece was placed on the Resitable. The double-ring-electrode of the UR probe was applied so as to be in contact with the surface to be measured. A weight having a mass of 2.0±0.1 kg (19.6±1.0 N) was attached to an upper part of the UR probe, so that certain load was applied to the test piece.

Measurement conditions were set such that a voltage application time was 30 seconds, and that an applied voltage was 100 volts (V). At that timer where R designates a value read on the R8340A digital ultrahigh-resistance/very small-current ammeter, and RCF(S) denotes the surface resistivity correction coefficient obtained by the UP probe MCP-HTP12, according to the catalog "resistivity meter series" by Dia Instruments, Co., Ltd, RCF(S)=10, so the surface resistivity ρs is given by the following expression (1).

$$\rho s(\Omega/\square)=R\times RCF(S)=R\times 10.0 \quad (1)$$

(Volume Resistivity)

Volume resistivity is defined as the value obtained by dividing the magnitude of electric current flowing between the front and rear surface of a test piece by the film thickness. The volume resistivity is equivalent to the volume resistance between two electrodes which are the opposite surfaces of a cube each side of which is 1 cm.

The measurement of the volume resistivity was performed using the digital ultrahigh-resistance/very small-current ammeter (R8340A manufactured by Advantest Corporation), the "UR probe" MCP-HTP12 having a double-ring-electrode structure whose connection part has been modified exclusively for R8340A, and the Resitable UFL MCP-ST03 (both manufactured by Dia Instruments, Co. Ltd.), which conform to Japanese Industrial Standards (JIS) K6911 (1995).

For the measurement, a metal surface was used as the lower electrode. Then, a test piece was placed on the Resitable. The double-ring-electrode part of the UR probe was used as the upper electrode. A weight having amass of 2.0±0.1 kg (19.6±1.0 N) was attached to the upper part of the UR probe, so that a certain load was applied onto the test piece.

Measurement conditions were: voltage application time of 30 seconds, and applied voltage that was changed according to conditions. At that time, where t is the thickness of the test piece (μm), R designates a value read on the digital ultrahigh-resistance/minute-current ammeter, and RCF(V) denotes a volume resistivity correction coefficient obtained by the UR probe MCP-HTP12, according to the Dia Instruments catalog "resistivity meter series", RCF(V) equals 2.1011, so the volume resistivity ρv is given by the following expression (2).

$$\rho s(\Omega\cdot\text{cm})=R\times RCF(V)\times(10000/t)=R\times 2.011\times(10000/t) \quad (2)$$

According to the above measurement method, the surface resistivity and the voltage resistivity were measured at 22° C. and at 55% relative humidity (RH), and at voltages of 10 V and 100 V.

(Evaluation of Transfer Image)

An endless belt was incorporated into an image forming apparatus (Docu-Centre-Color manufactured by Fuji Xerox Co., Ltd. reconstructed to be 4800 DPI) as an intermediate transfer belt. Thus, the quality of an image obtained by the image forming apparatus was evaluated. More specifically, half-tone density unevenness was evaluated at G=0.2 as an item for evaluation of the image quality. This was measured by an X-Rite densitometer (manufactured by X-Rite Corporation) When the variation amount was equal to or less than 5%, the evaluation was "A". When a variation amount was equal to or less than 10%, the evaluation was "B". When the variation amount was equal to or less than 15%, the evaluation was "C". The following Table 1 shows results of this measurement. However, in the case of Comparative Example 2, satisfactory belts were not obtained. Thus, the evaluation of the image quality was not performed in the case of Comparative Example 2.

TABLE 1

Test Results

| Items | Experimental Example 1 | Experimental Example 1 | Comparative Example 1 | Comparative Example 1 |
|---|---|---|---|---|
| Measurement Position | center | 50 mm from an end portion | center | 50 mm from an end portion |
| Film Thickness | 80 μm | 80 μm | 80 μm | 81 μm |
| Surface Resistivity: Outer Surface (LogΩ/□) | 13.4 | 13.3 | 13.4 | 14.5 |
| Surface Resistivity: Inner Surface (LogΩ/□) | 12.0 | 12.0 | 12.0 | 13.2 |
| Volume Resistivity at 10 V (LogΩ · cm) | 13.0 | 12.9 | 13.0 | 13.8 |
| Volume Resistivity at 100 V (LogΩ · cm) | 12.3 | 12.2 | 12.3 | 13.1 |
| Image Quality Evaluation | A | A | A | C |

According to the above results, Experimental Example 1 is favorable for use as an intermediate transfer belt.

On the other hand, Comparative Example 1 had a problem in that density unevenness occurred at the central portion and end portions.

Thus, it is clear that the endless belts according to the embodiments can be favorably used as the intermediate transfer belt in a high resolution image forming apparatus, allowing excellent quality of a transfer image.

Modification Examples

In the foregoing description, the embodiments of the invention have been described in detail. However, the invention is not limited to the above embodiments. Various modifications can be made within the gist of the invention described in the appended claims. Examples (H01) to (H06) of the modification of the invention are exemplified below.

(H01) In the foregoing description of the above embodiment, the image forming apparatus U includes a printer. However, the image forming apparatus according to the invention is not limited thereto. The image forming apparatus according to the invention can be constituted by a composite machine or the like having for example some or all of functions of a copying machine and a facsimile apparatus (FAX).

(H02) In the foregoing description of the above embodiment, the configuration of the above printer U is not limited to a printer using six color toners. The invention can be applied to an image forming apparatus using 7 colors or more, an image forming apparatus using 5 colors or more, and a monochrome image forming apparatus.

(H03) In the foregoing description of the above embodiment, the intermediate transfer belt B was the example of the endless belt-shaped body. The endless belt-shaped body according to the invention is not limited thereto. The invention can be applied to other endless belt-shaped bodies, e.g., a photosensitive belt, a charged belt, a recording medium conveying belt.

(H04) In the foregoing description of the above embodiment, the shape and the number of the ventilation holes 3*b* can optionally be changed according to the design and the specifications thereof.

(H05) In the foregoing description of the above embodiment, an example of the configuration of the cylindrical core in which the rotating shaft 4 is fit in the flanges 3 has been exemplified. However, the configuration of the cylindrical core is not limited thereto. The flanges 3 and the rotating shaft 4 can be fixed using a fixing device such as what is called a bracket.

(H06) In the foregoing description of the above embodiment, a disk was the configuration of the flange 3. However, the configuration of the flange is not limited thereto. A polygonal flange portion can be employed.

What is claimed is:

1. A cylindrical core for manufacturing an endless belt-shaped body, the cylindrical core comprising:

a cylindrical portion having two axial ends, an outer surface and an inner surface, the cylindrical portion including a cylinder whose cylindrical shape is not maintainable without support when the outer surface thereof is orthogonal to the direction of gravitational force; and flange portions that are detachably mounted on both axial ends of the cylindrical portion, wherein a coating film forming resin solution formed onto the outer surface or the inner surface of the cylindrical portion in a state in which the flange portions are mounted on the cylindrical portion, the coating film forming resin solution being adaptable to solidify when heated, the flange portions are configured to be removable following solidification of the coating film forming resin solution, thereby forming the endless belt, and wherein the flange portions have a step in a circumferential edge portion thereof, a radius of the step being less than a radius of the flange portions, a depth of the step being defined by a difference between the radius of the flange portions and the radius of the step, and the depth of the step of the flange portions is greater than a thickness of the cylindrical portion.

2. The cylindrical core according to claim 1, wherein the cylindrical portion has a thickness equal to or less than 1/100 of a diameter of the cylindrical portion.

3. The cylindrical core according to claim 1, wherein the cylindrical portion is made of a metal belt.

4. The cylindrical core according to claim 1, wherein the flange portions are made of a metal material or a thermally-resistant resin material.

5. The cylindrical core according to claim 1, wherein the flange portions are made of a metal material having a thickness of from 2 mm to 20 mm.

6. The cylindrical core according to claim 1, wherein a diameter inside the step is slightly smaller than an inside diameter of the cylindrical core.

7. The cylindrical core according to claim 1, wherein an arithmetic average of roughness of the outer surface or the inner surface of the cylindrical portion is in the range of 0.2 μm to 2 μM.

8. The cylindrical core according to claim 1, further comprising a plurality of tie rods, the plurality of tie rods adapted to hold the flange portions together.

9. The cylindrical core according to claim 8, wherein the plurality of tie rods extend along the axis of the cylindrical portion and are attached to the flange portions.

* * * * *